US011460282B1

(12) United States Patent
Wade et al.

(10) Patent No.: US 11,460,282 B1
(45) Date of Patent: Oct. 4, 2022

(54) INSENSITIVE MUNITION INITIATION CANISTER (IMIC)

(71) Applicant: Department of the Navy, Indian Head, MD (US)

(72) Inventors: James Wade, Waldorf, MD (US); Angel Diaz, Indian Head, MD (US); Lee Foltz, Indian Head, MD (US); Daniel McCarthy, LaPlata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 312 days.

(21) Appl. No.: 15/732,175

(22) Filed: Sep. 29, 2017

(51) Int. Cl.

| | |
|---|---|
| ***F42C 19/04*** | (2006.01) |
| ***F42C 19/02*** | (2006.01) |
| ***F42C 15/188*** | (2006.01) |
| ***F42B 3/11*** | (2006.01) |

(52) U.S. Cl.
CPC ..... *F42C 19/04* (2013.01); *F42C 15/188* (2013.01); *F42C 19/02* (2013.01); *F42B 3/11* (2013.01)

(58) Field of Classification Search
CPC .... F42B 3/10; F42B 3/103; F42B 3/11; F42C 14/00; F42C 14/06; F42C 15/188; F42C 15/19; F42C 15/02; F42C 15/04
USPC ..... 102/275.9, 275.11, 275.12
See application file for complete search history.

(56) References Cited

U.S. PATENT DOCUMENTS

| | | | | | |
|---|---|---|---|---|---|
| 128,945 | A * | 7/1872 | Browne | F42B 3/14 | 102/202.8 |
| 289,768 | A * | 12/1883 | Freund | F42B 3/103 | 102/202.14 |
| 372,046 | A * | 10/1887 | Stuart | F42B 3/103 | 102/202.9 |
| 3,800,656 | A | 4/1974 | Schnabele | | |
| 3,926,119 | A * | 12/1975 | Hurst | C06B 47/00 | 102/315 |
| 4,471,696 | A * | 9/1984 | Clayson | F42C 19/02 | 102/200 |
| 4,745,862 | A * | 5/1988 | Arnell | F42C 19/02 | 102/217 |
| 4,760,795 | A * | 8/1988 | Young | F42C 19/0838 | 102/293 |
| 4,920,852 | A * | 5/1990 | Miller | F42B 3/00 | 102/315 |
| 5,327,835 | A * | 7/1994 | Adams | F42D 1/043 | 102/275.11 |
| 5,417,162 | A * | 5/1995 | Adams | F42D 1/043 | 102/275.11 |

(Continued)

*Primary Examiner* — Bret Hayes
(74) *Attorney, Agent, or Firm* — Fredric J. Zimmerman

(57) ABSTRACT

An insensitive munition initiation canister includes a first cylindrical body having an external surface, which includes a first set of threads arranged circumferentially around the first cylindrical body, and a second cylindrical body connected to the first cylindrical body including an external surface having a second set of threads arranged circumferentially around the second cylindrical body. The first cylindrical body includes a first internal region set to retain an explosive charge having a detonation capability sufficient to detonate an insensitive munition. The first cylindrical body is set to sit inside a munition fuze well. The threads of the first cylindrical body are set to engage the munition fuze well.

13 Claims, 13 Drawing Sheets

(56) References Cited

U.S. PATENT DOCUMENTS

| | | | | |
|---|---|---|---|---|
| 6,508,176 | B1 * | 1/2003 | Badger | F42D 1/043 102/275.12 |
| 7,293,492 | B2 | 11/2007 | Brunn | |
| 7,549,374 | B2 | 6/2009 | Schwantes et al. | |
| 7,717,042 | B2 | 5/2010 | Lloyd | |
| 7,752,975 | B1 | 7/2010 | Yousef et al. | |
| 7,802,518 | B2 | 9/2010 | Schwantes et al. | |
| 7,814,834 | B2 | 10/2010 | Schwantes et al. | |
| 7,997,203 | B1 * | 8/2011 | Macri | F42B 3/103 102/202.12 |
| 8,234,979 | B1 * | 8/2012 | Falabella | F42B 12/207 102/275.9 |
| 8,550,004 | B1 | 10/2013 | Woo et al. | |
| 8,887,609 | B1 | 11/2014 | Cherry | |
| 9,243,876 | B1 | 1/2016 | Botthof et al. | |
| 9,441,894 | B1 | 9/2016 | Moy | |
| 9,476,683 | B2 | 10/2016 | Marchais et al. | |
| 2012/0240806 | A1 * | 9/2012 | Gonsalves | C06C 7/00 102/275.11 |
| 2017/0191814 | A1 | 7/2017 | Grace et al. | |

* cited by examiner

INSENSITIVE MUNITION INITIATION CANISTER (IMIC)

GOVERNMENT INTEREST

The embodiments described herein may be manufactured, used, and/or licensed by or for the United States Government without the payment of royalties thereon.

BACKGROUND

Technical Field

The embodiments herein generally relate to munitions technology, and more particularly to insensitive munition technology.

Description of the Related Art

Insensitive explosive-filled munitions typically have an explosive fill which does not easily detonate from outside stimuli (bullet impact, shaped charge, fragment impact, thermal fire event, etc.). Generally, conventional methods to dispose (high order) insensitive munitions (IM) either require a large amount of energetics placed on or next to the round or by physically packing the fuze well with explosives to generate enough pressure/time into the munition to consume or fully react the insensitive fill and to obtain a high order detonation. Furthermore, while disposing a single round with conventional methods is not time consuming or tedious, trying to dispose a stockpile (10s to 100s) of IM rounds may be rather time consuming or tedious for explosive ordnance disposal (EOD) forces.

SUMMARY

In view of the foregoing, an embodiment herein provides an insensitive munition initiation canister including a first body comprising an external surface having threads arranged circumferentially around the first body; and a second body connected to the first body, wherein the first body includes a first internal region set to retain an explosive charge having a detonation capability sufficient to detonate an insensitive munition, and wherein the first body is set to fit within the insensitive munition. The insensitive munition initiation canister may further include a first cap operatively connected to the second body. The insensitive munition initiation canister may further include a second cap operatively connected to the first body. The insensitive munition initiation canister may further comprise a lip on the first body, wherein the second cap is operatively connected to the lip. The first body may be circumferentially larger than the second body. The first body may be longer than the second body. The second body may comprise threads circumferentially disposed around an outer surface of the second body. The second body may be set to accommodate a detonation cord. The first internal region of the first body may connect with a second internal region of the second body. Each of the first body and the second body may be cylindrical. The first body may be set to sit inside a munition fuze well. The insensitive munition may be approximately 20 mm to 400 mm in diameter.

Another embodiment provides an insensitive munition initiation canister including a first cylindrical body comprising an external surface having a first set of threads arranged circumferentially around the first cylindrical body; and a second cylindrical body connected to the first cylindrical body comprising an external surface having a second set of threads arranged circumferentially around the second cylindrical body. The first cylindrical body comprises a first internal region set to retain an explosive charge having a detonation capability sufficient to detonate an insensitive munition. The threads of the first cylindrical body are set to engage the insensitive munition. The first cylindrical body is set to sit inside a munition fuze well. The insensitive munition initiation canister further comprises a first cap operatively connected to the second cylindrical body. The insensitive munition initiation canister further comprises a second cap operatively connected to the first cylindrical body. The insensitive munition initiation canister further comprises a lip on the first cylindrical body, wherein the second cap is operatively connected to the lip. The first cylindrical body is circumferentially larger than the second cylindrical body. The first cylindrical body is longer than the second cylindrical body. The second cylindrical body is set to accommodate a detonation cord. The first internal region of the first cylindrical body connects with a second internal region of the second cylindrical body. Each of the first cylindrical body, the second cylindrical body, the first cap, the second cap, and the lip may comprise plastic material.

These and other aspects of the embodiments herein will be better appreciated and understood when considered in conjunction with the following description and the accompanying drawings. It should be understood, however, that the following descriptions, while indicating exemplary embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 2:
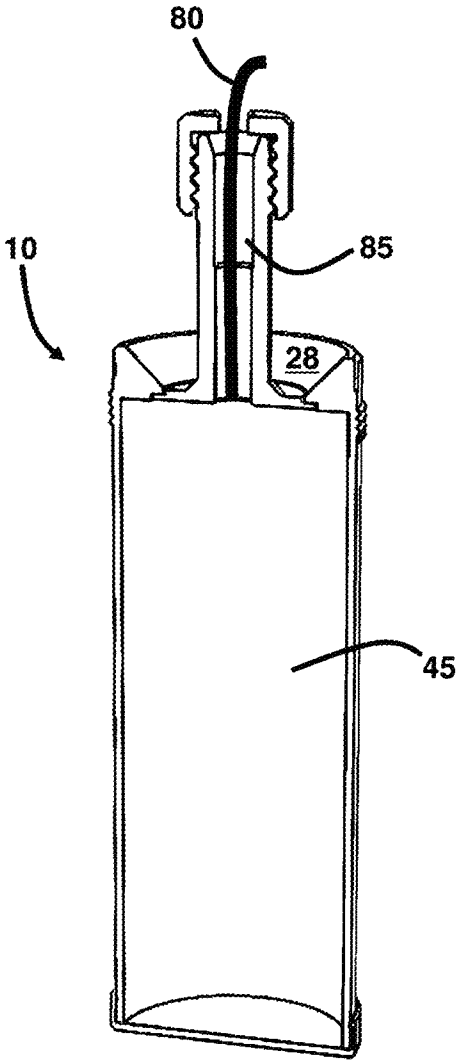
FIG. 2 is a cross-sectional view of the insensitive munition initiation canister of FIG. 1, according to an embodiment herein.
Figure 1:
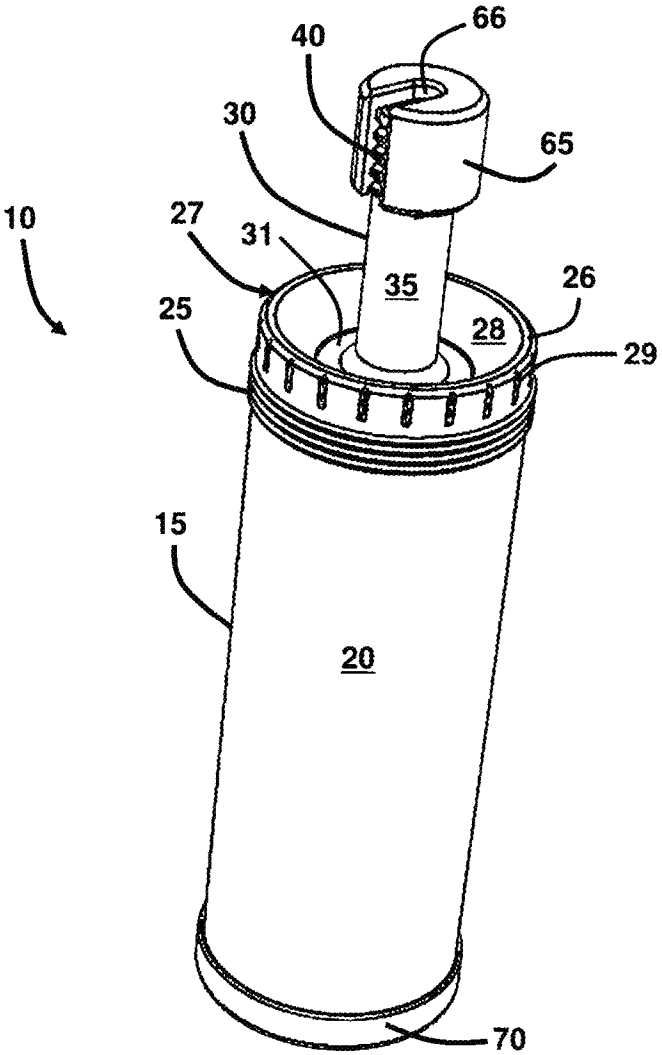
FIG. 1 is a schematic diagram illustrating an insensitive munition initiation canister, according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide an insensitive munition initiation canister, which allows Joint Service Explosive Ordnance Disposal (JSEOD) personnel to dispose of a stockpile of IM rounds in a timely, less tedious manner than using conventional energetic field pack methods. The canister provided by the embodiments herein decrease the time in the field to dispose of a stockpile of IM rounds. Referring now to the drawings, and more particularly to FIGS. 1 through 6*i*, there are shown exemplary embodiments.

FIGS. 1 through 4 are schematic diagrams illustrating an insensitive munition initiation canister 10, according to an exemplary embodiment herein. The insensitive munition initiation canister 10 includes a first cylindrical body 15 comprising an external surface 20 having a first set of threads 25 arranged circumferentially around the first cylindrical body 15. A second cylindrical body 30 is connected to the first cylindrical body 15 and includes an external surface 35 having a second set of threads 40 arranged circumferentially around the second cylindrical body 30. The first cylindrical body 15 may include an upper ring 26 positioned above the first set of threads 25 on an upper region 27 of the first cylindrical body 15. In an example, the first cylindrical body 30 and the second cylindrical body 30 may include plastic material, such as, acrylonitrile butadiene styrene (ABS) plastic material.

The upper region 27 of the first cylindrical body 15 includes a substantially angled inner surface 28, which extends downward to a base 31 where the second cylindrical body 30 engages the first cylindrical body 15. The upper ring 26 may include a plurality of slots 29 disposed circumferentially around the upper ring 26. The plurality of slots 29 do not extend through to the inner surface 28, in one example.

Figure 4:
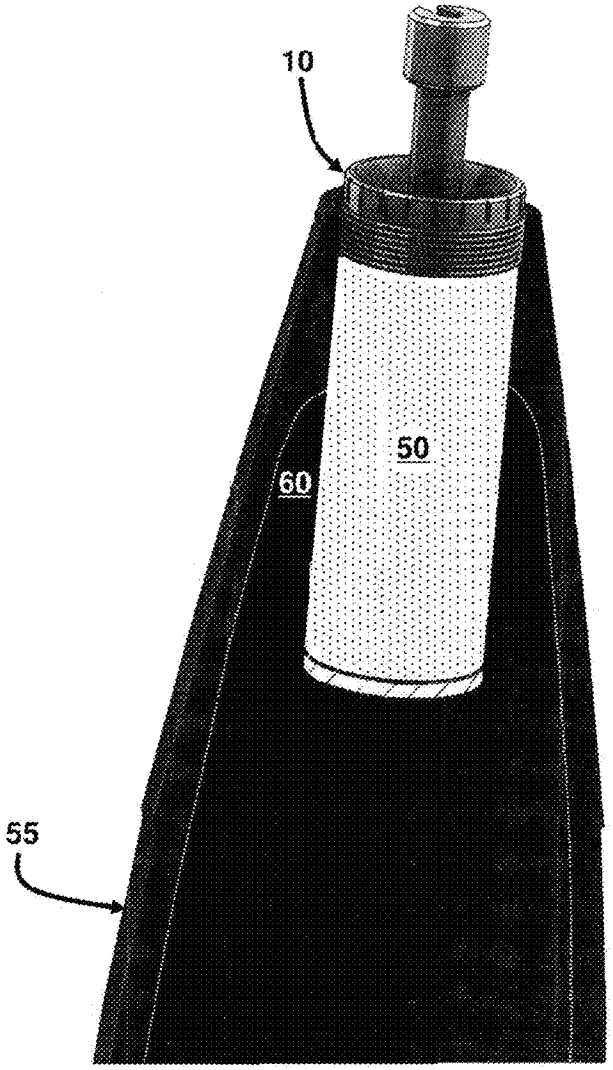
FIG. 4 is a schematic diagram illustrating an insensitive munition initiation canister seated in an insensitive munition, according to an embodiment herein.

The first cylindrical body 15 includes a first internal region 45, as shown in FIG. 2, set to retain an explosive charge 50, shown in FIG. 4, having a detonation capability sufficient to detonate an insensitive munition 55, shown in FIG. 4. In one example, the explosive charge 50 may comprise C-4 explosive. This configuration allows a user to pack the first cylindrical body 15 in the field and not at a manufacturing plant. However, more powerful explosives also may be used in packing the first cylindrical body 15 in accordance with the embodiments herein. The first cylindrical body 15 is depicted as a transparent body in FIG. 4 to depict the position of the explosive charge 50 therein. The threads 25 of the first cylindrical body 15 are set to engage a corresponding set of threads (not shown) in the fuze well 60 of the insensitive munition 55. The first cylindrical body 15 is set to sit inside a munition fuze well 60 of the munition 55, shown in FIG. 4. The diameter and length of the first cylindrical body 15 may be configured to match the corresponding diameter and length of the fuze well 60. In an example, each of the diameter and length of the first cylindrical body 15 and the fuze well 60 may range between about one and about six inches. However, the sizes may include other ranges and dimensions depending on the type and size of the munition 55. Moreover, the plurality of slots 29 in the first cylindrical body 15 may assist in increasing the gripping interface between a user's hands and the canister 10 when being threaded into the fuze well 60.

Figure 3:
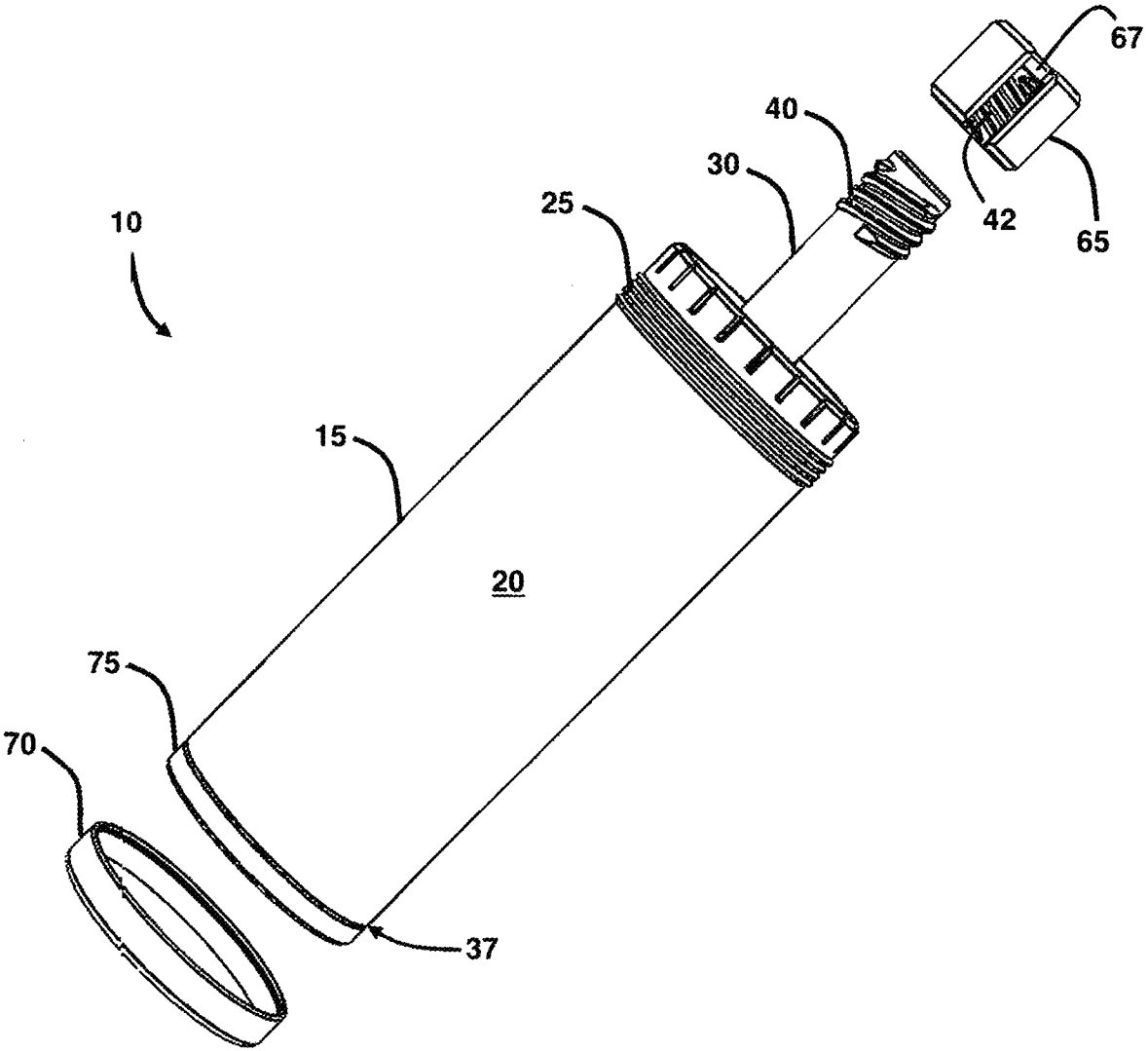
FIG. 3 is a schematic diagram illustrating an insensitive munition initiation canister with some components detached, according to an embodiment herein.

The insensitive munition initiation canister 10 further includes a first cap 65 operatively connected to the second cylindrical body 30. In one example, the first cap 65 may include a cylindrical shape, and the first cap 65 may comprise a slot 66 configured therethrough. The slot 66 exposes the second set of threads 40 when the first cap 65 is connected to the second cylindrical body 30. The insensitive munition initiation canister 10 further includes a second cap 70 operatively connected to the first cylindrical body 15. The first cap 65 may be a blasting cap which includes threads 42 which are configured to engage the second set of threads 40 of the second cylindrical body 30. The threads 42 are configured on an inner surface 67 of the first cap 65, as shown in FIG. 3. The second cap 70 may be a canister cap that is provided for storage, and which is connected to the bottom of the canister 10.

The insensitive munition initiation canister 10 further comprises a lip 75 on a bottom region 37 of the first cylindrical body 15, where the second cap 70 is operatively connected to the lip 75. In one example, the second cap 70 is press fit to the lip 75. The first cylindrical body 15 may be circumferentially larger than the second cylindrical body 30. The first cylindrical body 15 may be longer than the second cylindrical body 30. The second cylindrical body 30 is set to accommodate a detonation cord 80. The first internal region 45 of the first cylindrical body 15 connects with a second internal region 85 of the second cylindrical body 30. In one example, the insensitive munition 55 is approximately 20 mm to 400 mm in diameter. In an example, the first cap 65, the second cap 70, and the lip 75 may comprise plastic material such as ABS plastic material.

Figure 5A:
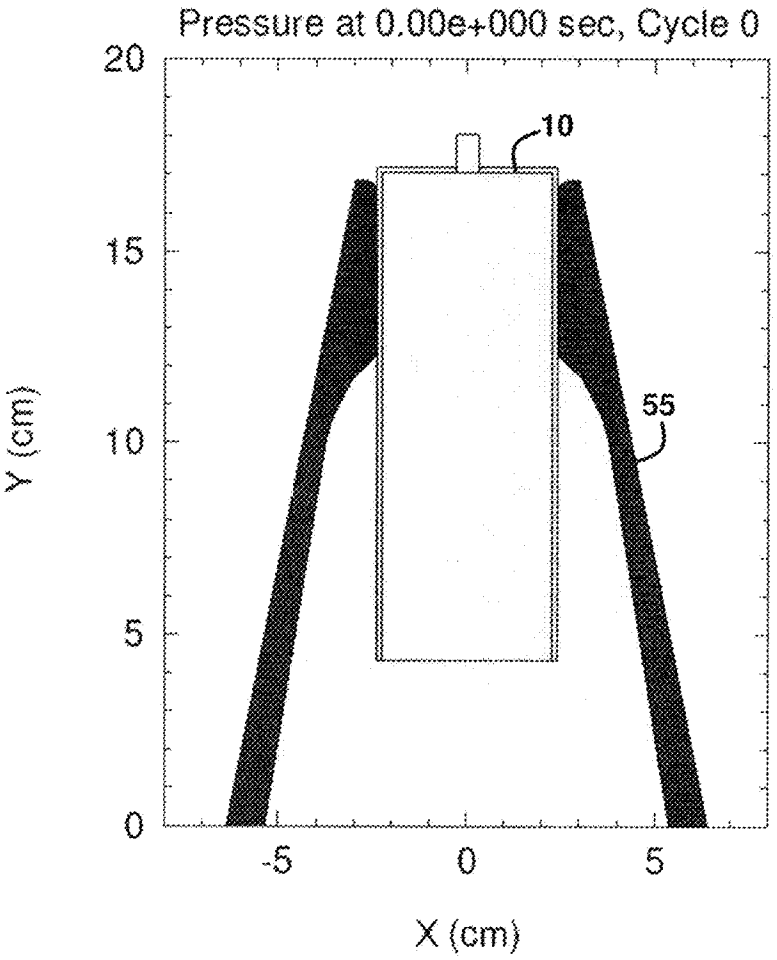
FIG. 5*a* is a detonation pressure wave illustration of an insensitive munition initiation canister seated in an insensitive munition prior to detonation, according to an embodiment herein.
Figure 5B:
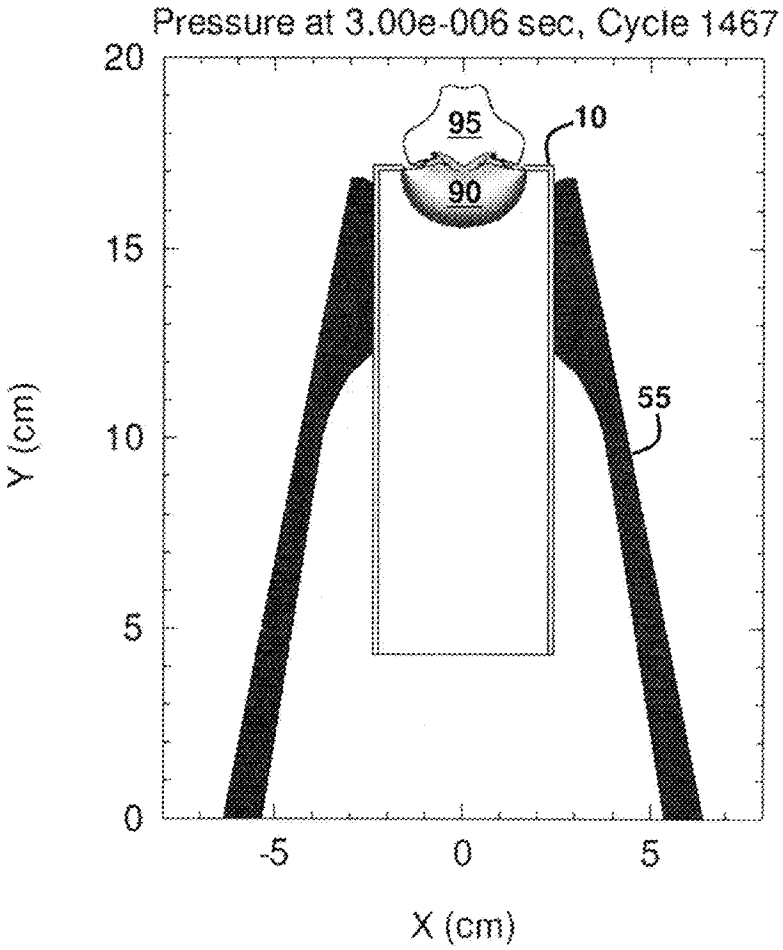
FIG. 5*b* is a detonation pressure wave illustration of an insensitive munition initiation canister seated in an insensitive munition at $3\times10^{-6}$ seconds after detonation, according to an embodiment herein.
Figure 5D:
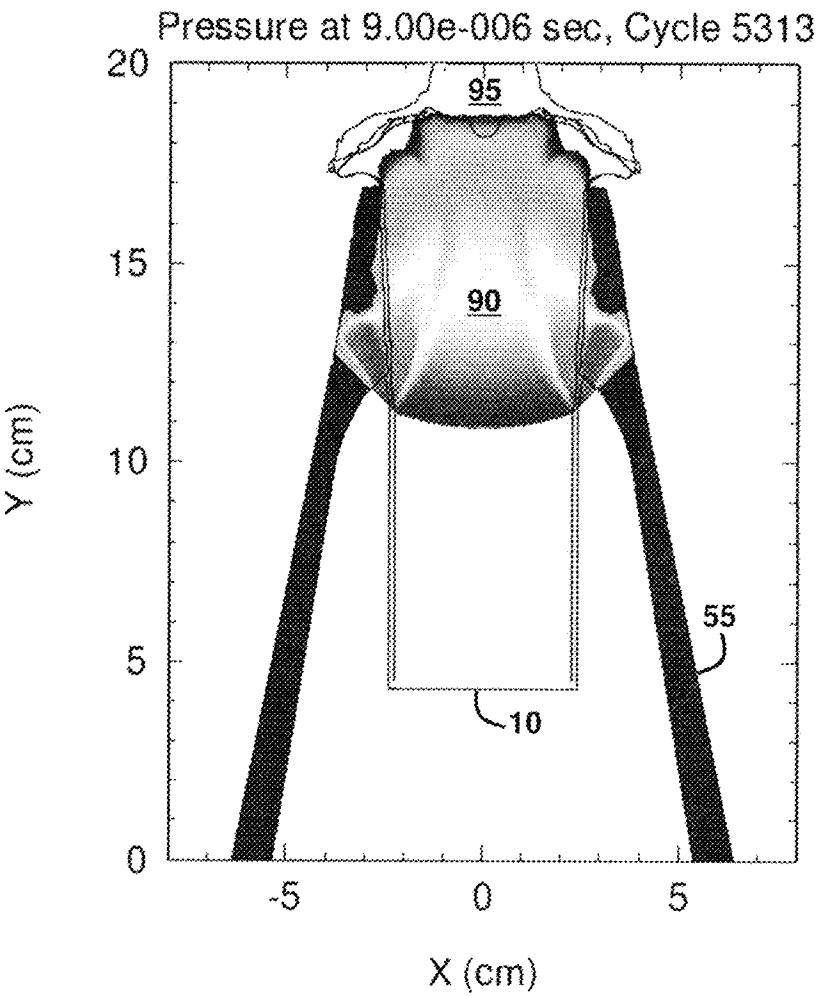
FIG. 5*d* is a detonation pressure wave illustration of an insensitive munition initiation canister seated in an insensitive munition at $9\times10^{-6}$ seconds after detonation, according to an embodiment herein.
Figure 5C:
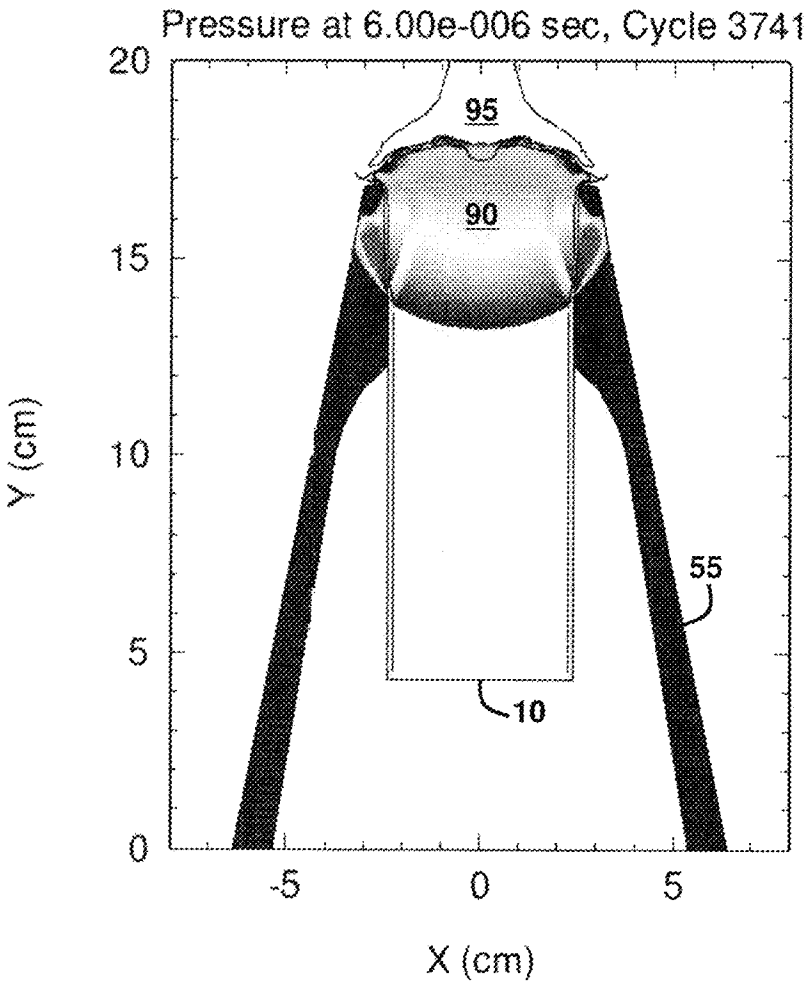
FIG. 5*c* is a detonation pressure wave illustration of an insensitive munition initiation canister seated in an insensitive munition at $6\times10^{-6}$ seconds after detonation, according to an embodiment herein.
Figure 5F:
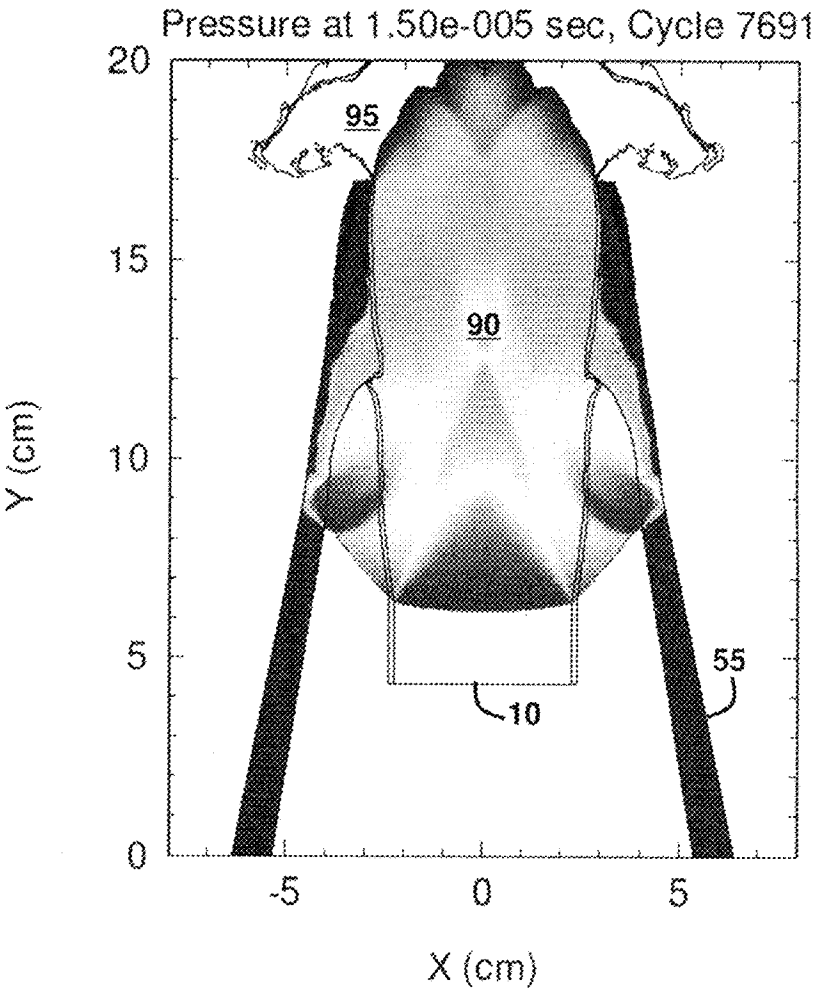
FIG. 5*f* is a detonation pressure wave illustration of an insensitive munition initiation canister seated in an insensitive munition at $1.5\times10^{-5}$ seconds after detonation, according to an embodiment herein.
Figure 5E:
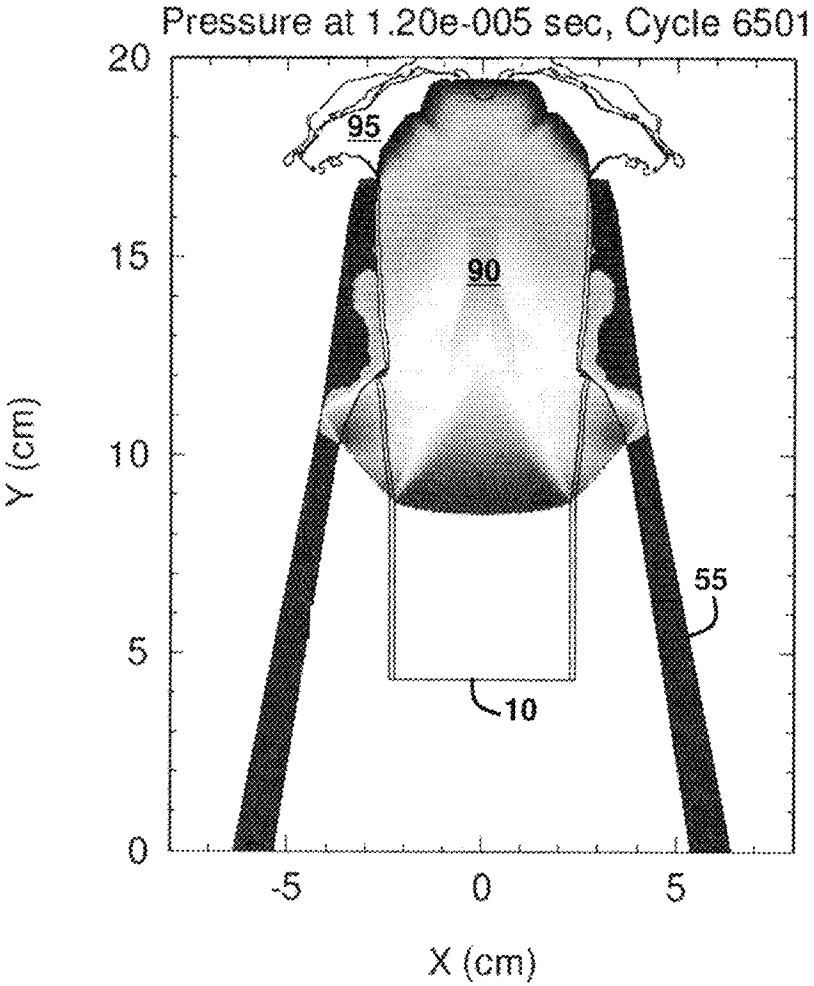
FIG. 5*e* is a detonation pressure wave illustration of an insensitive munition initiation canister seated in an insensitive munition at $1.2\times10^{-5}$ seconds after detonation, according to an embodiment herein.
Figure 5H:
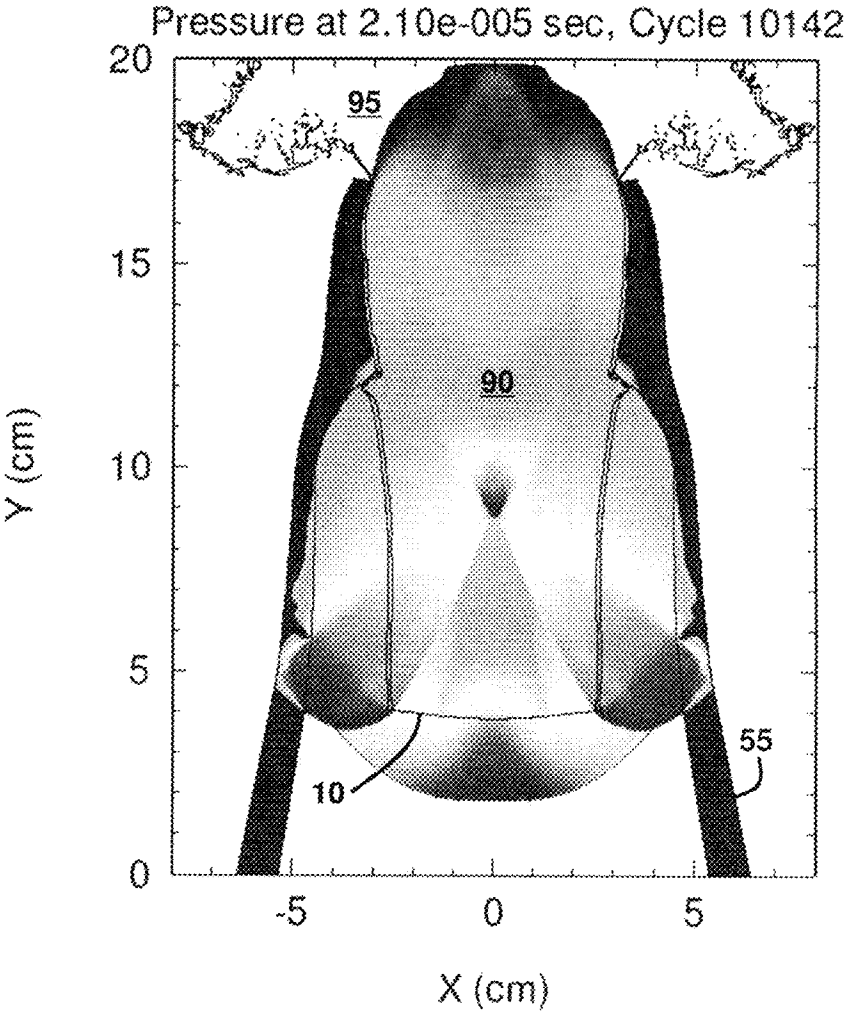
FIG. 5*h* is a detonation pressure wave illustration of an insensitive munition initiation canister seated in an insensitive munition at $2.1\times10^{-5}$ seconds after detonation, according to an embodiment herein.
Figure 5G:
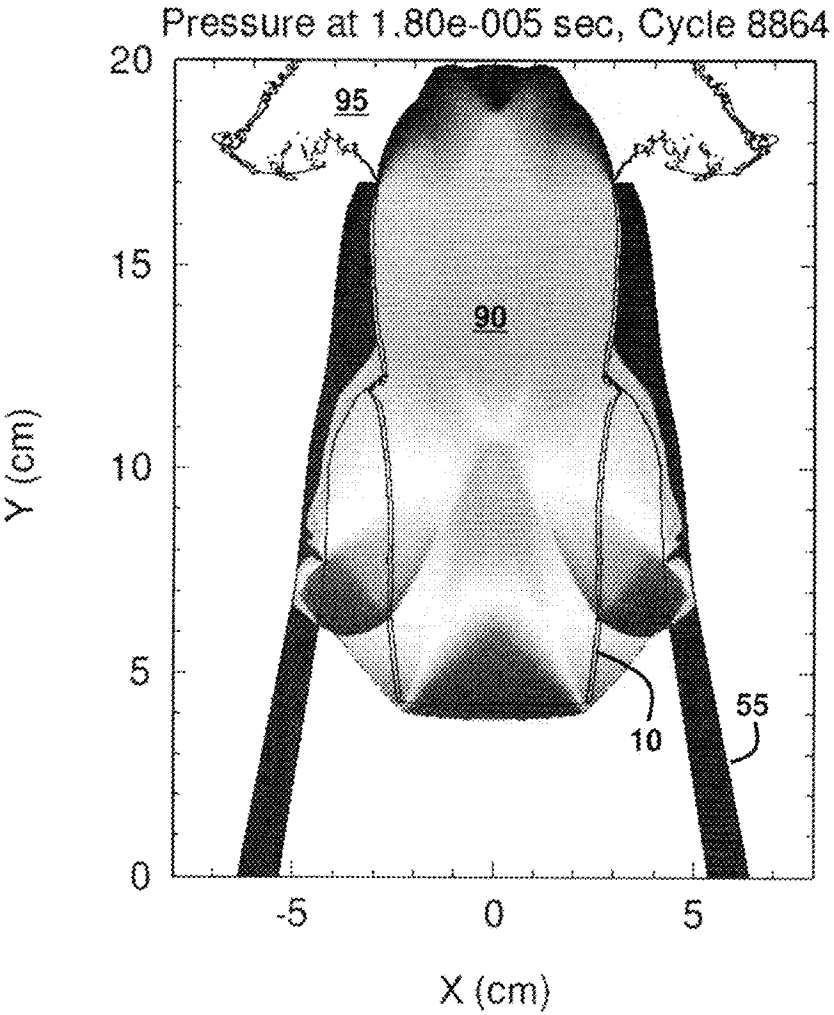
FIG. 5*g* is a detonation pressure wave illustration of an insensitive munition initiation canister seated in an insensitive munition at $1.8\times10^{-5}$ seconds after detonation, according to an embodiment herein.
Figure 5I:
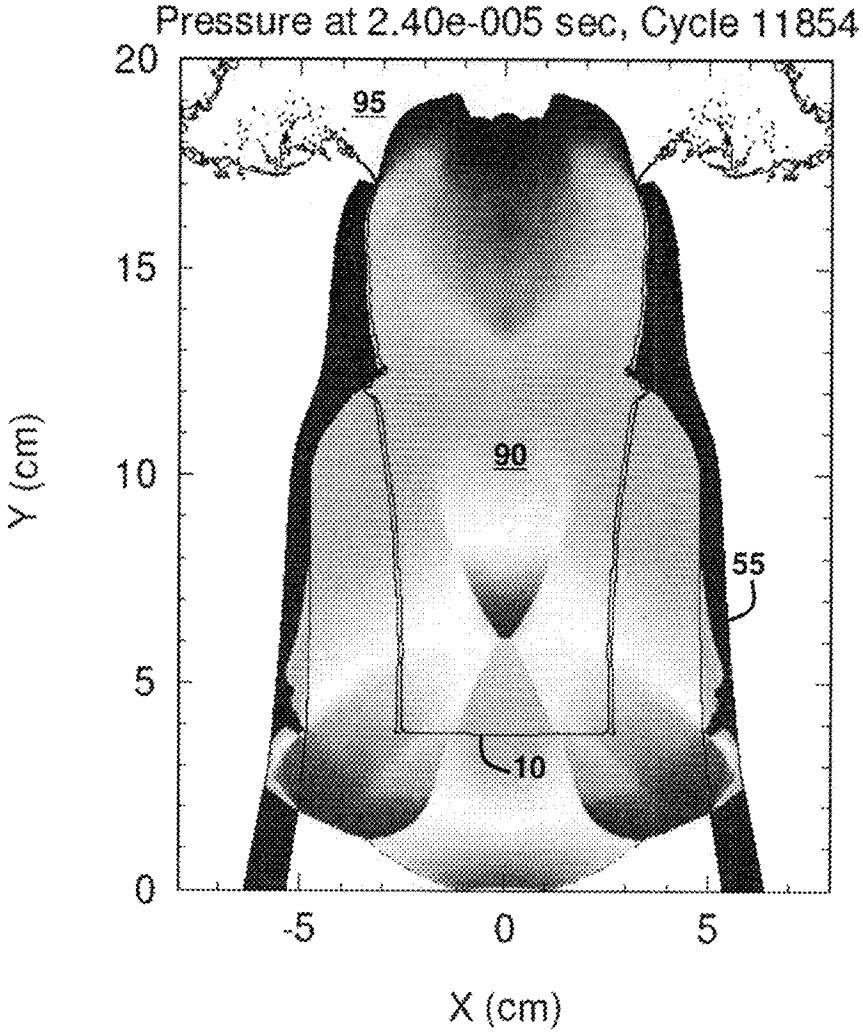
FIG. 5*i* is a detonation pressure wave illustration of an insensitive munition initiation canister seated in an insensitive munition at $2.4\times10^{-5}$ seconds after detonation, according to an embodiment herein.

FIGS. 5*a* through 5*i*, with reference to FIGS. 1 through 4, are detonation pressure wave illustrations of the insensitive munition initiation canister 10 seated in the insensitive munition 55, according to an embodiment herein. FIG. 5*a* is a detonation pressure wave illustration of the insensitive munition initiation canister 10 seated in the insensitive munition 55 prior to detonation. FIGS. 5*b* through 5*i* sequentially illustrate the detonation pressure wave illustrations taken at $3\times10^{-6}$ seconds, $6\times10^{-6}$ seconds, $9\times10^{-6}$ seconds, $1.2\times10^{-5}$ seconds, $1.5\times10^{-5}$ seconds, $1.8\times10^{-5}$ seconds, $2.1\times10^{-5}$ seconds, and $2.4\times10^{-5}$ seconds, respectively, after detonation. Area 90 depicts the detonation pressure wave profile within the canister 10 and/or munition 55, and area 95 depicts the blast profile of the canister 10. As the detonation pressure wave increases, the blast area also increases, which corresponds with the detonation of the canister 10.

Figure 6A:
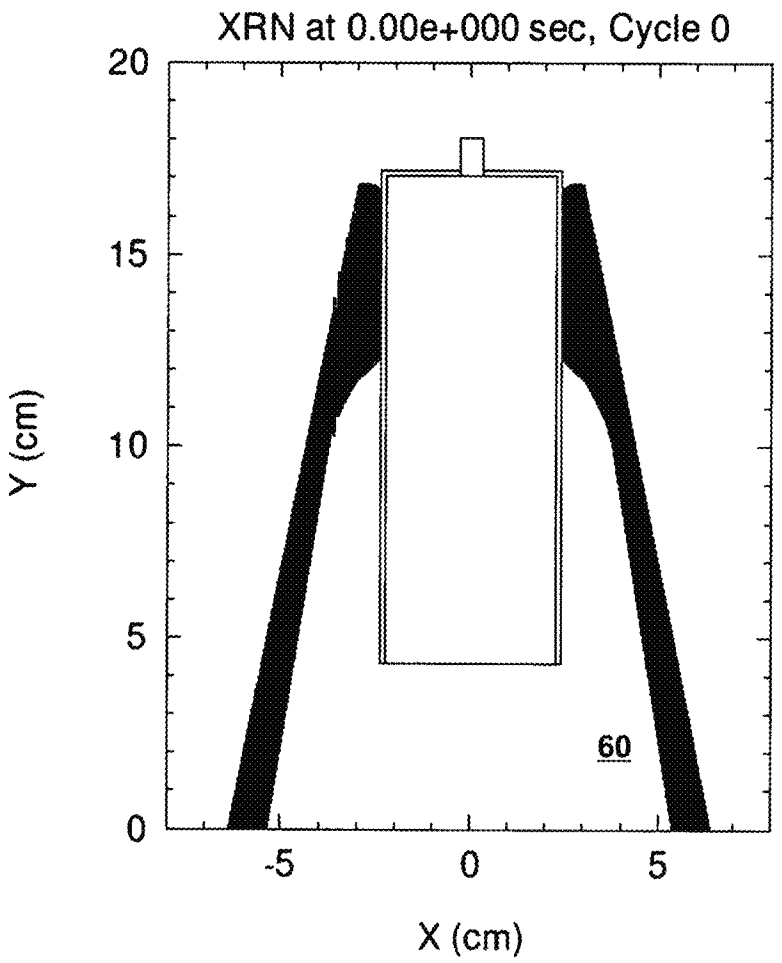
FIG. 6*a* is an illustration of the reaction of a fuze well prior to detonation, according to an embodiment herein.
Figure 6B:
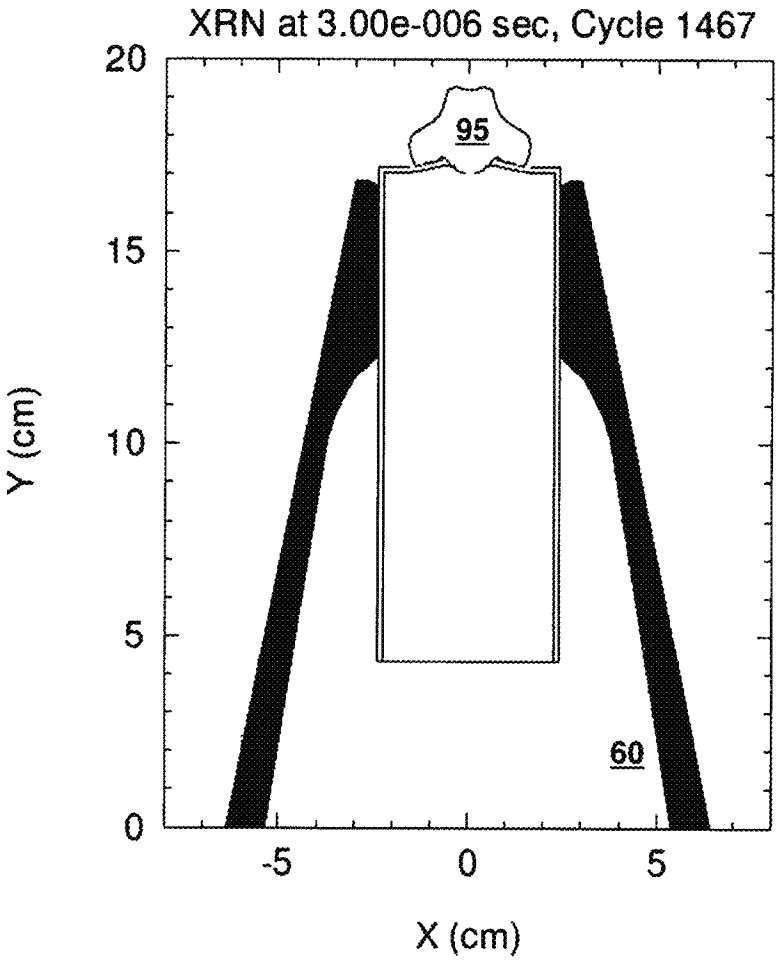
FIG. 6*b* is an illustration of the reaction of a fuze well at $3\times10^{-6}$ seconds after detonation, according to an embodiment herein.
Figure 6C:
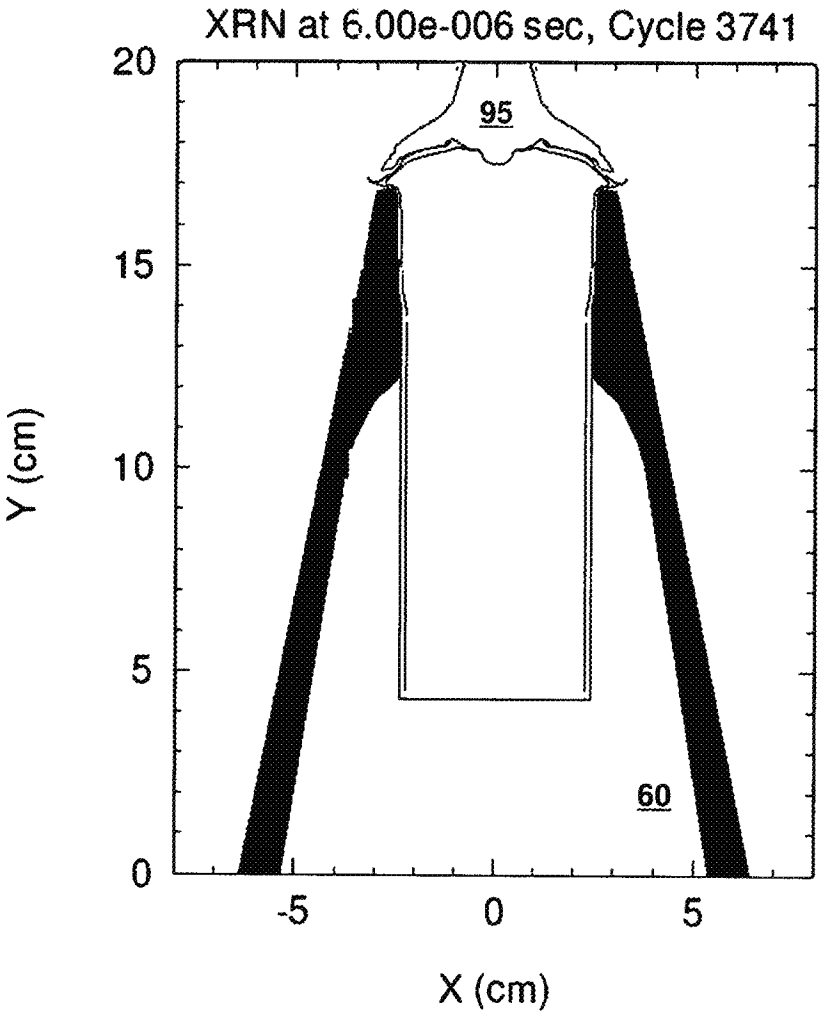
FIG. 6*c* is an illustration of the reaction of a fuze well at $6\times10^{-6}$ seconds after detonation, according to an embodiment herein.
Figure 6D:
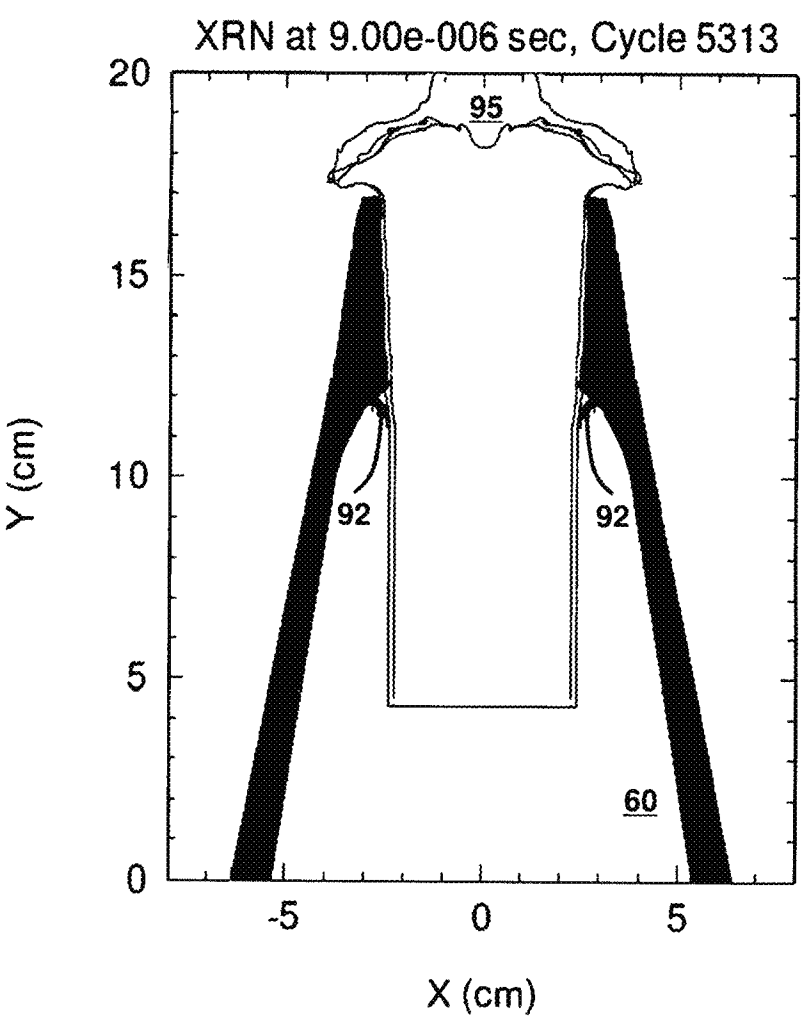
FIG. 6*d* is an illustration of the reaction of a fuze well at $9\times10^{-6}$ seconds after detonation, according to an embodiment herein.
Figure 6F:
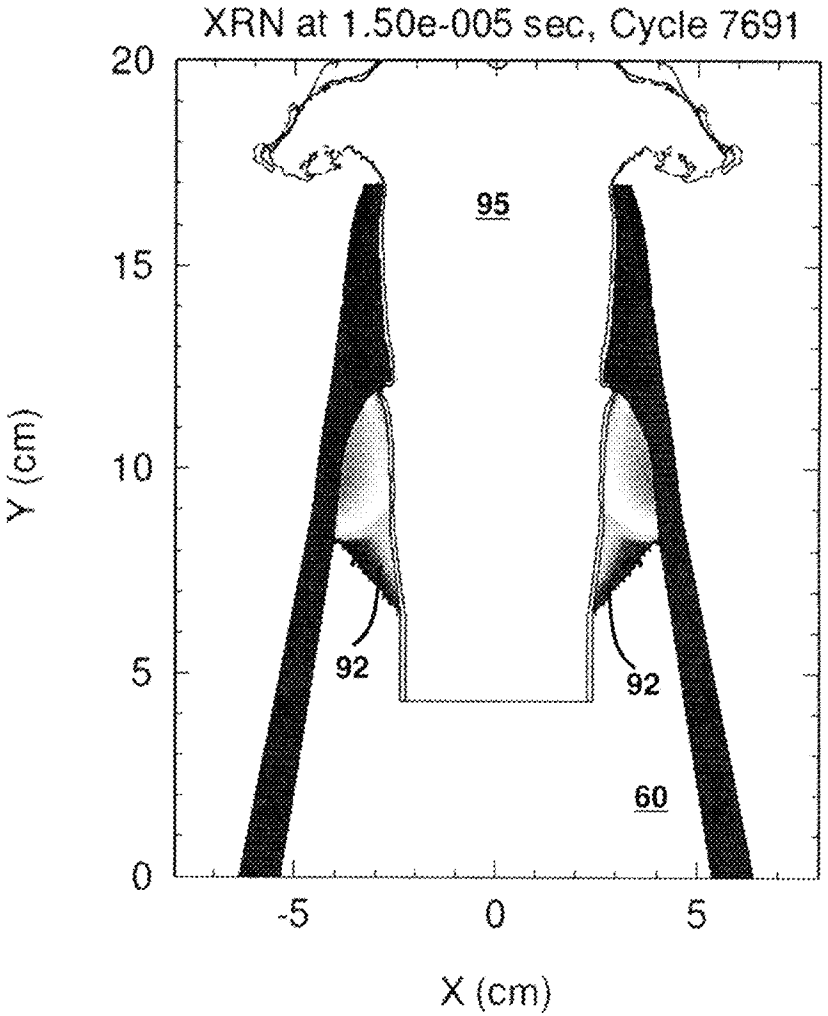
FIG. 6*f* is an illustration of the reaction of a fuze well at $1.5\times10^{-5}$ seconds after detonation, according to an embodiment herein.
Figure 6E:
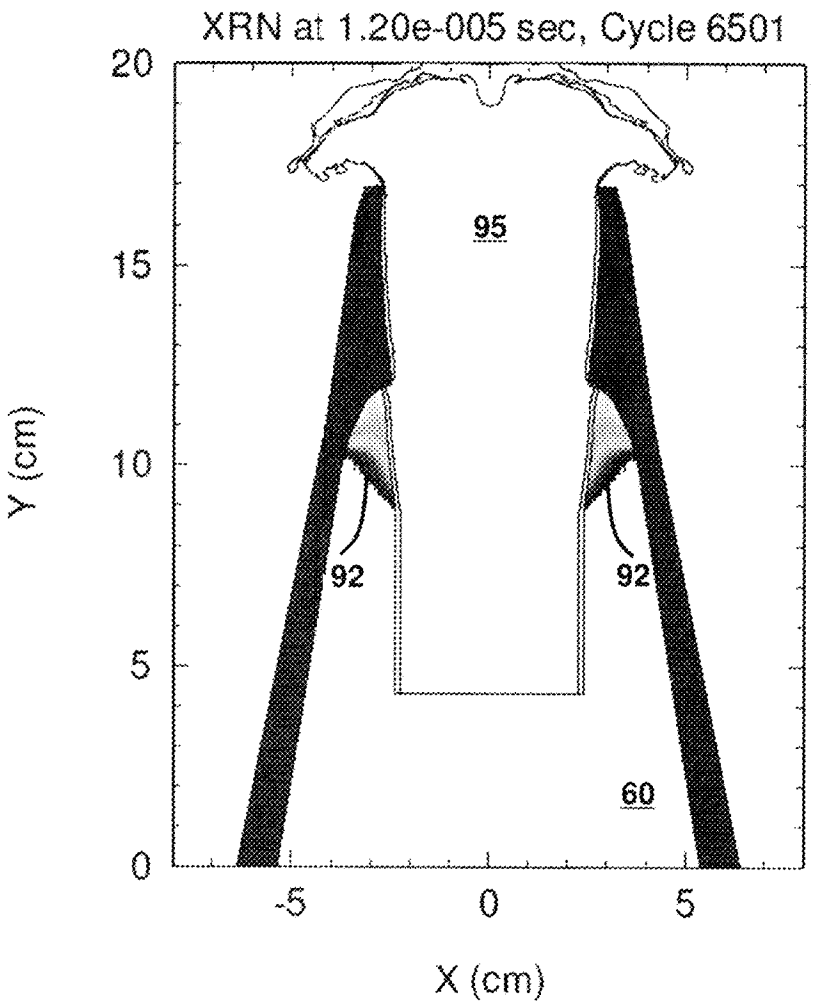
FIG. 6*e* is an illustration of the reaction of a fuze well at $1.2\times10^{-5}$ seconds after detonation, according to an embodiment herein.
Figure 6H:
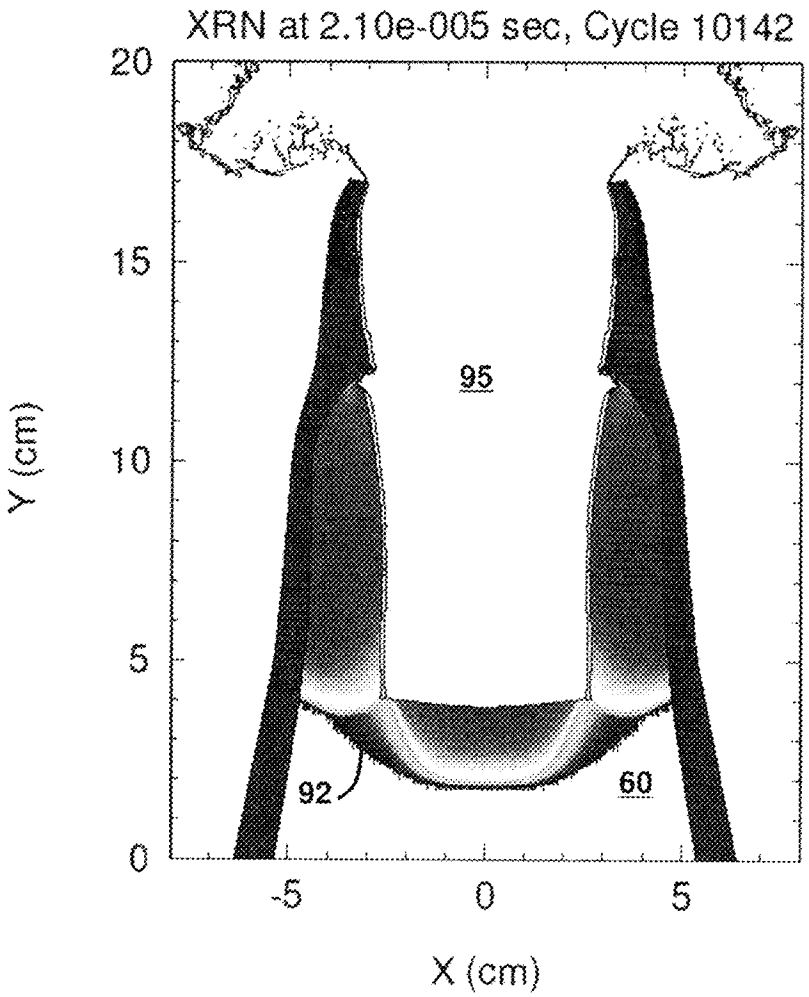
FIG. 6*h* is an illustration of the reaction of a fuze well at $2.1\times10^{-5}$ seconds after detonation, according to an embodiment herein.
Figure 6G:
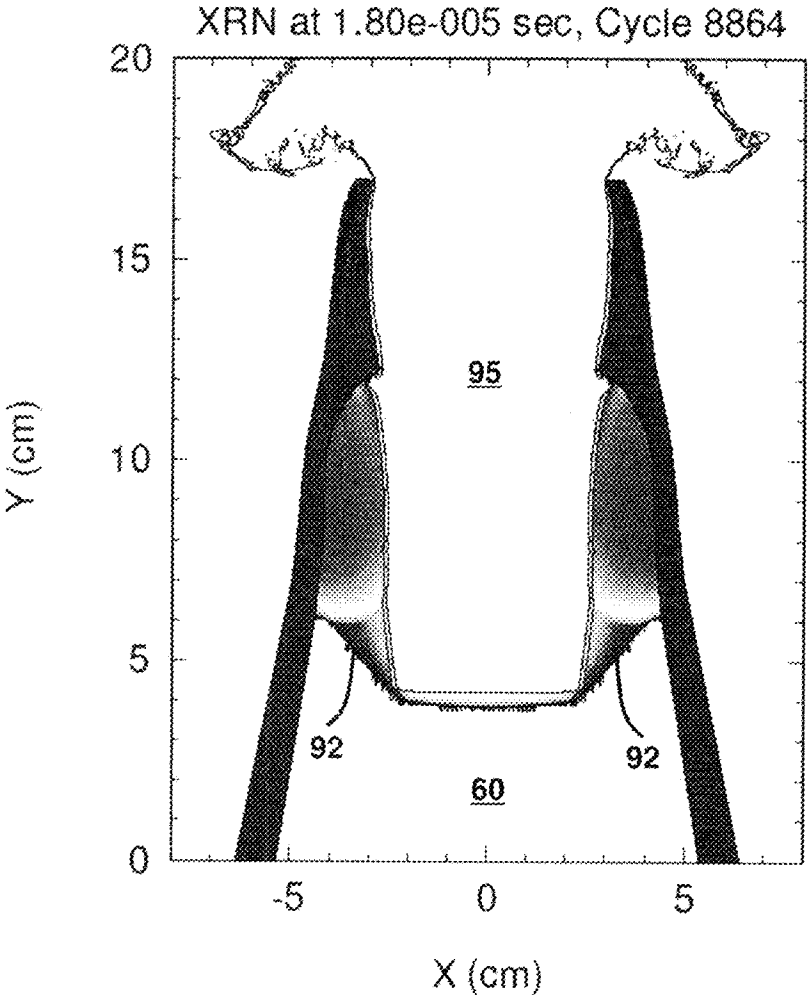
FIG. 6*g* is an illustration of the reaction of a fuze well at $1.8\times10^{-5}$ seconds after detonation, according to an embodiment herein.
Figure 6I:
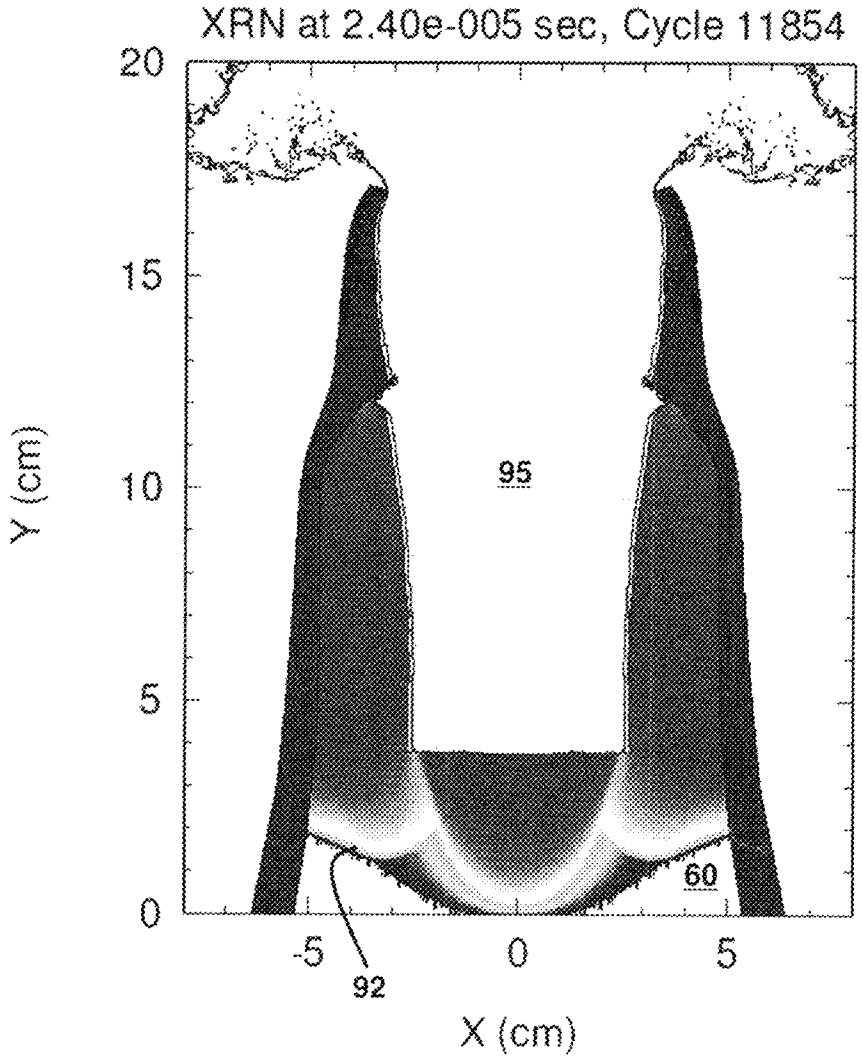
FIG. 6*i* is an illustration of the reaction of a fuze well at $2.4\times10^{-5}$ seconds after detonation, according to an embodiment herein.

FIGS. 6*a* through 6*i*, with reference to FIGS. 1 through 5*i*, are illustrations of the fuze well 60 during detonation, according to an embodiment herein. FIG. 6*a* is an illustration of the fuze well 60 prior to detonation. FIGS. 6*b* through 6*i* sequentially illustrate the reaction of the fuze well 60 taken at $3\times10^{-6}$ seconds, $6\times10^{-6}$ seconds, $9\times10^{-6}$ seconds, $1.2\times10^{-5}$ seconds, $1.5\times10^{-5}$ seconds, $1.8\times10^{-5}$ seconds, $2.1\times10^{-5}$ seconds, and $2.4\times10^{-5}$ seconds, respectively, after detonation. Area 92 depicts the reaction profile of the fuze well 60, and area 95 depicts the blast profile of the canister 10. As the detonation proceeds, the reaction in the fuze well 60 also increases.

The embodiments herein provide an insensitive munition initiation canister 10 threaded into the fuze well 60 of an insensitive explosive-filled munition 55. The insensitive munition initiation canister charge 50 propagates a detonation wave 90 inside the insensitive explosive filled munition 55. The insensitive munition initiation canister charge 50 allows C-4 or other type of explosive to be filled inside the canister 10, and the canister 10 gets threaded into the fuze well 60. This structural arrangement saves time and the amount of energetic material needed for the operator to dispose of the munition 55. This arrangement is especially useful when there may be a large number of rounds to dispose of at the same time. Initiation of the insensitive munition initiation canister charge 50 may be accomplished using the blasting cap 65 or detonation cord 80 tied directly into the explosive area (e.g., internal region 45). The embodiments herein allow explosive ordnance disposal (EOD) personnel to dispose of a stockpile of IM rounds in a timely, less tedious manner compared with using conventional energetic field pack methods. The embodiments herein decrease the time in the field to dispose of a stockpile of IM rounds.

The foregoing description of the specific embodiments will so fully reveal the general nature of the embodiments herein that others may, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of exemplary embodiments, those skilled in the art will recognize that the embodiments herein can be practiced with modification within the spirit and scope of the appended claims.

What is claimed is:

1. An insensitive munition initiation canister, consisting of: a first body comprising an external surface including a first plurality of
threads arranged circumferentially around the first body;
a second body being connected to the first body;
a first cap, a second cap operatively connected to the first body; and
a lip on the first body, wherein the second cap is operatively connected to the lip;
wherein the first body comprises a first internal region set to retain an explosive charge,
wherein the first body is configured to fit within an insensitive munition,
wherein the second body includes a second internal region configured to accommodate a detonation cord within the second internal region, wherein the first plurality of threads engage with a munition fuze well,
wherein the second body comprises a second plurality of threads circumferentially disposed around an outer surface of the second body operatively connected to the first cap,
wherein the detonation cord is a single segment detonation cord,
wherein the insensitive munition initiation canister is a single density pack canister where the explosive charge is a single explosive charge located in the first internal region, and
wherein the second internal region is situated on top of the first internal region.

2. The insensitive munition initiation canister of claim 1, wherein the first cap is a first blasting cap.

3. The insensitive munition initiation canister of claim 1, wherein the first body is circumferentially larger than the second body.

4. The insensitive munition initiation canister of claim 1, wherein the first body is longer than the second body.

5. The insensitive munition initiation canister of claim 1, wherein the first internal region of the first body connects with a second internal region of the second body.

6. The insensitive munition initiation canister of claim 1, wherein each of the first body and the second body are cylindrical.

7. The insensitive munition initiation canister of claim 1, wherein the insensitive munition is about 20 mm to 400 mm in diameter.

8. An insensitive munition initiation canister system, consisting of:

a first cylindrical body comprising an external surface having a first set of threads being arranged circumferentially around the first cylindrical body;

a second cylindrical body being connected to the first cylindrical body comprising an external surface with a second set of threads being arranged circumferentially around the second cylindrical body;

a first cap;

a detonation cord, a second cap operatively connected to the first cylindrical body; and a lip located on the first cylindrical body, wherein the second cap is operatively connected to the lip;

wherein the first cylindrical body comprises a first internal region set to retain an explosive charge, wherein the first cylindrical body is configured to sit inside a munition fuze well, wherein the first set of threads are set to engage the munition fuze well, wherein the second body includes a second internal region configured to accommodate the detonation cord within the second internal region, wherein the second body comprises a second plurality of threads circumferentially disposed around an outer surface of the second body operatively connected to the first cap, wherein the detonation cord is a single segment detonation cord, wherein the insensitive munition initiation canister is a single density pack canister where the explosive charge is a single explosive charge located in the first internal region, and wherein the second internal region is situated on top of the first internal region.

9. The insensitive munition initiation canister of claim 8, wherein the first cylindrical body includes an upper region, wherein the upper region includes an angled inner surface, which extends downward to a base, and wherein the second cylindrical body engages the first cylindrical body at the base.

10. The insensitive munition initiation canister of claim 9, wherein each of the first cylindrical body, the second cylindrical body, the first cap, the second cap, and the lip is comprised of a plastic material.

11. The insensitive munition initiation canister of claim 8, wherein the first cylindrical body is longer and circumferentially larger than the second cylindrical body.

12. The insensitive munition initiation canister of claim 8, wherein the first internal region of the first cylindrical body connects with a second internal region of the second cylindrical body.

13. An insensitive munition initiation canister, comprising:

a first body comprising an external surface including a first plurality of threads arranged circumferentially around the first body;

a second body being connected to the first body; and a first cap being operatively connected to the second body, wherein the first body comprises a first internal region set to retain an explosive charge, wherein the first body is configured to fit within an insensitive munition, wherein the second body includes a second internal region, wherein the first plurality of threads engage with a munition fuze well, wherein the second body comprise a second plurality of threads circumferentially disposed around an outer surface of the second body, wherein the insensitive munition initiation canister is a single density pack canister where the explosive charge is a single explosive charge located in the first internal region, wherein the second internal region is situated on top of the first internal region, wherein the first body includes an upper region, wherein the upper region includes an angled inner surface, which extends downward to a base, and wherein the second cylindrical body engages the first cylindrical body at the base.

* * * * *